US007898414B2

(12) United States Patent
Spano

(10) Patent No.: US 7,898,414 B2
(45) Date of Patent: Mar. 1, 2011

(54) SYSTEM FOR LOCATING AND PREVENTING THE LOSS OF PERSONAL ITEMS AND THE LIKE WITHIN A GEOGRAPHIC RANGE RELATIVE TO A USER

(76) Inventor: Michael J. Spano, New York, NY (US)

( * ) Notice: Subject to any disclaimer, the term of this patent is extended or adjusted under 35 U.S.C. 154(b) by 432 days.

(21) Appl. No.: 11/872,299

(22) Filed: Oct. 15, 2007

(65) Prior Publication Data

US 2009/0045958 A1 Feb. 19, 2009

Related U.S. Application Data

(60) Provisional application No. 60/955,652, filed on Aug. 14, 2007.

(51) Int. Cl.
*G08B 13/14* (2006.01)

(52) U.S. Cl. ..... 340/571; 340/539.23; 340/539.21; 340/539.15; 340/573.1; 340/539.13

(58) Field of Classification Search ..... 340/539.32, 340/572.1, 539.23, 539.21, 5.2, 571, 426, 340/573.1, 10.5, 10.42, 568.6, 573.4, 573.13
See application file for complete search history.

(56) References Cited

U.S. PATENT DOCUMENTS 5,289,163 A * 2/1994 Perez et al. ..... 340/539.32
5,952,921 A * 9/1999 Donnelly ..... 340/568.6
6,297,737 B1 * 10/2001 Irvin ..... 340/571
6,331,817 B1 * 12/2001 Goldberg ..... 340/573.1
6,686,840 B1 * 2/2004 Hammond et al. ..... 340/568.7
6,693,537 B2 * 2/2004 Frank ..... 340/568.1
6,956,475 B1 * 10/2005 Hill ..... 340/539.11
6,956,480 B2 * 10/2005 Jespersen ..... 340/568.1
7,034,684 B2 * 4/2006 Boman et al. ..... 340/568.1
7,106,191 B1 * 9/2006 Liberati ..... 340/539.15
7,148,801 B2 12/2006 Crabtree et al.
7,271,715 B2 * 9/2007 Aupperle et al. ..... 340/539.13
7,274,292 B2 * 9/2007 Velhal et al. ..... 340/539.32
7,696,887 B1 * 4/2010 Echavarria ..... 340/573.1
2002/0014955 A1 * 2/2002 Klitsgaard ..... 340/10.42
2002/0097152 A1 * 7/2002 Mengrone et al. ..... 340/571
2002/0113705 A1 * 8/2002 Wallace ..... 340/568.7
2003/0063003 A1 * 4/2003 Bero et al. ..... 340/573.1
2004/0130448 A1 * 7/2004 McDonald et al. ..... 340/572.1
2004/0217859 A1 * 11/2004 Pucci et al. ..... 340/539.32
2005/0088302 A1 * 4/2005 Pucci et al. ..... 340/568.1
2005/0099318 A1 * 5/2005 Gilfix et al. ..... 340/825.19
2005/0148339 A1 * 7/2005 Boman et al. ..... 455/456.1

(Continued)

*Primary Examiner* — George A Bugg
*Assistant Examiner* — Hoi C Lau
(74) *Attorney, Agent, or Firm* — F. Rhett Brockington

(57) ABSTRACT

The invention is a system for locating and preventing the loss of personal items within a geographic zone. The system components are a personal portable homing center device a having a radio frequency receiver and a transducer that is actuated by a change in a signal strength; and several zone devices, for instance an active RFID tag attached to the personal item. The homing center device has an algorithm to measure the strength of the signal generated by the tag. The transducer is an audible and/or a silent alarm. The homing center device has three operating modes: Off, Homing-in, and Homing-out. In the Homing-in mode the alarm is actuated when a zone device's signal is detected. In the Homing-out operating mode the alarm is actuated when a zone device's signal falls to a threshold strength, indicating that the item is no longer close to the homing center device.

18 Claims, 4 Drawing Sheets

U.S. PATENT DOCUMENTS

2005/0285739 A1* 12/2005 Velhal et al. ..... 340/572.1
2007/0008129 A1* 1/2007 Soliman ..... 340/572.1
2007/0188324 A1* 8/2007 Ballin et al. ..... 340/572.1
2007/0273514 A1* 11/2007 Winand et al. ..... 340/572.1
2008/0042844 A1* 2/2008 Christopher ..... 340/572.4
2008/0084334 A1* 4/2008 Ballew ..... 340/990
2009/0040022 A1* 2/2009 Finkenzeller ..... 340/10.1
2009/0040041 A1* 2/2009 Janetis et al. ..... 340/539.13
2009/0040051 A1* 2/2009 DeRieux et al. ..... 340/573.1

* cited by examiner

SYSTEM FOR LOCATING AND PREVENTING THE LOSS OF PERSONAL ITEMS AND THE LIKE WITHIN A GEOGRAPHIC RANGE RELATIVE TO A USER

CROSS REFERENCE TO RELATED PATENT APPLICATIONS

The application claims the benefit of the priority filing date of the provisional application bearing Ser. No. 60/955,652 filed on Aug. 14, 2007, titled "System for Locating Personal items and the Like", which is hereby incorporated by reference in its entirety.

BACKGROUND OF THE INVENTION

1) Field of the Invention

The invention relates generally to tracking systems, and more particularly to a system and method for locating and preventing the loss of personal items and the like within a predefined zone.

2) Prior Art and Statement of the Problem

People are carrying more and more personal items in their everyday lives to improve their communication, entertainment, and organization. In addition to carrying keys, a means for carrying money, credit cards. ID cards, possibly medicine, food, etc.; most people also carry a cell phone, and many carry some type of other digital device, such as a calculator, a hand-held computer, cameras or a scanning device. Unless these items are physically attached to the person then there is a high probability that they will be left or lost at some point in time. To complicate the scenario, all of these items are mass produced, and in crowed places many people will have the same color cell phone, or suitcase, or computer bag, or briefcase, or purse, and it is very easy to simply mistake another's personal item for one's own.

U.S. Pat. No. 7,148,801 to Crabtree et al. discloses a system for locating objects such as people, pets, and personal articles, wherein a transceiver is attached to the person, animal, or item to be tracked and a handheld locator device is employed to transmit a locator signal containing an address code to the transceiver. Upon receipt of a signal, the transceiver compares the address code contained in the locator signal with an address code stored in the transceiver. If the two codes are same, the transceiver sends a return signal back to the locator device. The locator device uses this return signal to determine the distance and/or direction of the transceiver from the user's location. The system allows a user to select from a multiple number of items to locate and allows multiple users to search for different articles within the same general area without interference.

What is needed is a system and method that prevents the loss of personal items, as well as locate and identify them. The system and method aid the user in not only locating an item, but also notifies the user when an item is outside a predetermined zone or range of the user. Such a system would prevent the loss of most items, and significantly narrow the geographic area that needs to be searched if an item is forgotten, misplaced, or otherwise missing, because the user is quickly made aware that the item is no longer within a specified distance of the user.

SUMMARY OF THE INVENTION

The invention is a system and method for locating and preventing the loss of personal items and the like within a geographic range relative to a user of the system. The system comprises a personal portable homing center device that is a receiver and a transducer that is actuated by a sensed change in the strength of a received signal; and at least one zone device which is a small portable transmitter emitting a unique signal; where the homing center device has an algorithm to measure the strength of the transmitted unique signal. The zone device is typically the size of a watch battery or an RFID tag, and the zone device has a means for attaching it to personal items and the like. Examples of the attaching means are an adhesive surface and a key chain type ring on one side, where the attaching means that enables the zone device to be easily attached to a set of keys, a wallet, in a purse, to a cell phone, or on luggage, and to other personal items. Alternatively, the item could be manufacture with an inclusive zone device build in to the item. These manufactured items having the inclusive zone device could be functional, like a tool, a room key, a luggage tag, or a fake designed to resemble something else. For example, a fake key to attach to your key chain, that isn't really a key but the zone device disguised to be inconspicuous. Another example is a fake credit card to put in your wallet.

One homing center device can monitor multiple zone devices. The homing center device can be easily carried, for instance in a small pant's pocket, on a belt loop, or on a bracelet. The transducer is typically an audible alarm (such as a buzzer, a tone or other noise generating apparatus) and/or a silent alarm, such as a vibrating apparatus. The homing center device preferably has a means for selecting the alarm.

The homing center device has operating modes, where each of the operating modes is selectable, for instance by a switch or a button. The operating modes are comprised of: an Off mode, a Homing-in mode for locating items, and a Homing-out mode for preventing the loss of items. In the Off mode the homing center device is turned off. The receiver will not detect signals transmitted by the zone device. In the Homing-in mode the transducer is actuated when the homing center device detects the unique signal emitted by a zone device. The Homing-in operating mode is used to detect a zone device attached to a personal item that is moving into a geographic range detectible by the receiver of the personal portable homing center device. For instance, an airline passenger would attach the zone device to a piece of luggage before checking it in at the airline. At the baggage claim when the baggage gets within a certain distance of the passenger's homing center device, the transmitted signal is detected, and the transducer is actuated. The passenger knows that his bag is in the vicinity, as it is uniquely marked by a transmitted signal that only his homing device will recognize. The strength of the signal has to be strong enough to be detected, and the closer the receiver is to the unique signal emanating from the zone device, the stronger the detected signal. In the case of radio frequency signals, the Friis equation predicts that the signal strength (power) is inversely related to the square of $4\pi d$, where d is the distance between the transmitter and the receiver. Therefore, the signal strength increases significantly as the homing center device and the zone device come closer together. The Homing-out operating mode is used to keep one's belongings with them, and the transducer is actuated when items having an attached zone device move a predefined distance away from the wearer of the homing center device. As previously discussed, as the distance between the transmitter and receiver increases, the signal strength decreases, and if the signal strength falls to a threshold level, then the transducer is actuated. In operation a zone device is attached to items which are normally kept in close proximity, such as keys, wallets, purse, cell phones, etc. The homing center device is set to Homing-out, and attached to oneself some place different than where one keeps their readily used items, for instance in a coin pocket, on belt loop, or a bracelet. The alarm on the homing center sounds as soon as any of the personal items having an attached zone devices are separated a predefined distance from the homing center device. The predefined distance is typically a value of 20 feet or less. As an illustration, assume that after paying for something at a store counter, one walks away leaving their keys on the counter. As user begins to walk away, a warning alarm lets the user know that they have forgotten one of their possessions.

Alternatively, the system can be configured wherein the operating Homing-out parameter for the threshold level between the specific zone device and the homing center device is used to monitor that tools and the like are not taken off a work site, and the threshold level parameter is selected to be a significantly longer distance, on the order of 1000 feet or less. If the item is left at the work site then it can be searched for using the Homing-in mode.

Preferably, the homing center device has switches for independently selecting the operating modes. For instance, one switch for monitoring zone devices for Off or Homing-in, and a second switch for monitoring zone devices for Off or Homing-out. The unique signal identifies a particular zone device, so that the homing center device can differentiate between zone devices as to whether they are being monitored for Homing-out operation or Homing-in operation. The unique signal can convey a digital ID, and other information, such as the useful life left in the power source (battery) driving the transmitter, the frequency, die strength of the signal being generated, and the identity of the personal item that the zone device is affixed to. The personal item may be keys, a suitcase, a purse, a cell phone, an item of clothing (i.e. mink coat), a computer, a briefcase, and the like. The attached zoning device can provide this information, or alternatively the digital ID can be cross-referenced to a unique identifier retained by the homing center device. The homing center device associates a specific zone device and operating mode with a specific personal item.

BRIEF DESCRIPTION OF THE DRAWINGS

The foregoing and other objects will become readily apparent by referring to the following detailed description and the appended drawings in which;

FIG. 2 is a schematic of a method for locating and preventing the loss of personal items and the like;

FIG. 3 is a schematic of an alternate method for locating and preventing the loss of personal items and the like;

DETAILED DESCRIPTION

Figure 1:
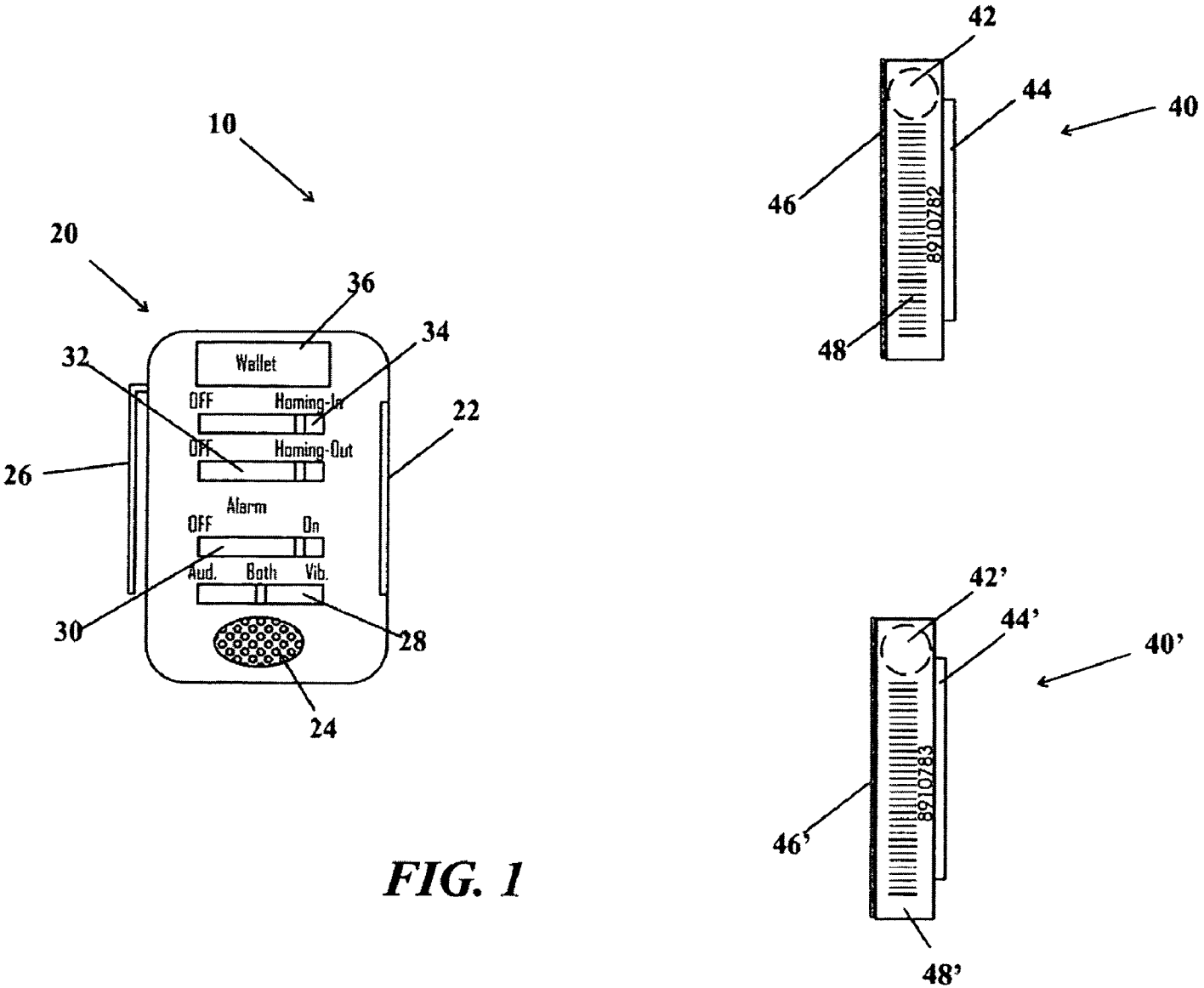
FIG. 1 is an illustration of a system for locating and preventing the loss of personal items and the like within a geographic range relative to a user of the system.
Figure 5:
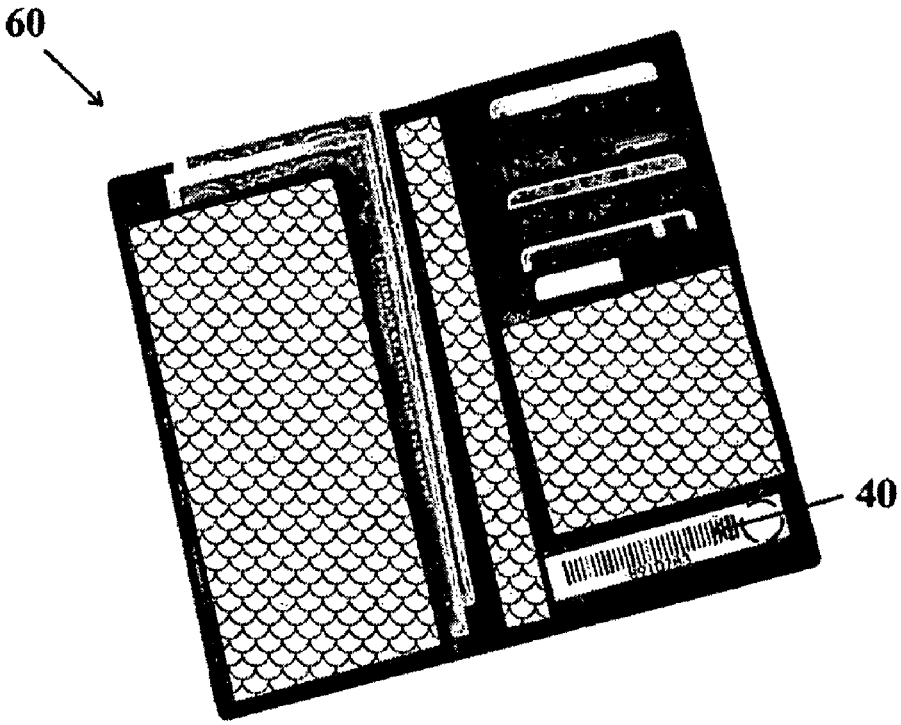
FIG. 5 is an illustration of a personal item having an attached zone device.

A system 10 for locating personal items and the like within a geographic range or a zone relative to a user of the system is illustrated in FIG. 1. The system comprises a homing center device 20, which is a reader of active RFID tags; and at least one zone device. Two active RFID tags 40, 40' are illustrated. Active RFID tags have their own power source (usually a battery), enabling them to broadcast an identifying signal, which is typically a digital ID. Being able to broadcast extends the range of active RFID tags, and also the capability for communicating more information, such as a starting location. Passive RFIDs, on the other hand, don't require a power source, but are not suitable for identifying personal items, except at a very close range (within a few feet). The illustrated homing center device 20 is small enough to fit into a pocket. The homing center device has a clip 26 to attach it to a belt. There is an antenna 22 for receiving the RF signal from multiple and varied zone devices. The antenna 22 is omnidirectional, as illustrated, or directional (i.e. Yagi), or both. The homing center device has a microprocessor (not shown) that runs a RSSI algorithm. RSSI is an acronym for Received Signal Strength Indication. The algorithm determines the distance separating the active RFID tag/zone device 40 from the homing center device by measuring the power of the radio signal. The homing center device 20 has switches for turning the transducer which is an alarm on/off 30, and a switch 28 for selecting either the audible alarm (Aud.), the silent alarm (Vib.), or both. The speaker 24 for the alarm is illustrated. The vibrator is not shown, but can be inferred. The homing center device 20 has an on/off switch for the Homing-in mode of operation 34, and an on/off switch for the Homing-out mode of operation 32. The illustrated device 20 also has a screen 36 that displays what personal item has been detected when the transducer alarm is actuated. The homing center device 20 keeps track of which RFID tag/zone device 40 is on what personal item. "Wallet" is shown on the display 36, and illustrated in FIG. 5, indicating that a wallet 60 has been left behind, and an alarm is issuing a warning. The Homing-out mode prevents the loss of items like a wallet, which is an item that one would ordinarily keep in close proximity to the homing center device 20.

The Homing-out mode can also be used to keep track of issued items that are used in a controlled geographic area, such as a work site or plant. The issuer would select a threshold level operating parameter to match the controlled geographic area. The type and number of antennae on the homing center device may have to be configured for non-radial controlled geographic areas. In this application the Homing-out mode is a deterrent to loss through theft and accidental removal of the item. If the items are not returned to the central location from they are issued, and the transducer has not been activated, then they are still on the premises. The issuer of the items has the option of switching to the Homing-in mode to facilitate searching the site for the issued item.

Two zone devices 40, 40' are illustrated in FIG. 1. As previously stated, the devices are active RFID tags, and as such have a unique code 48, 48', a battery 42, 42' (shown as a dashed circle), a transmitting antenna 44, 44', and an attaching means 46, 46', which is an adhesive strip. The unique code is shown on the surface as a bar code and a number. The RFID unique code is typically transmitted as a digital ID. The RFID tags can operate at a unique frequency, but preferably uniqueness is contained in the transmitted information, not just as a unique frequency. It is anticipated that the shift of active RFIDs is toward higher frequencies, in part, so that more information can be communicated. Low-frequency (LF: 125-134.2 kHz and 140-148.5 kHz) and high-frequency (HF: 13.56 MHz) RFID tags can be used globally without a license. Ultra-high frequency tags are also used but require a license. Preferably, zone devices that are used for Homing-in mode operate at a higher strength transmitting level than zone devices operating in the Homing-out mode, to conserve power. Energy conserving features, such as intermittent transmission, can be utilized. Likewise, the homing center device can be adjusted so that the alarm is actuated at a different level of reception for the Homing-in mode than for the Homing-out mode.

Figure 4:
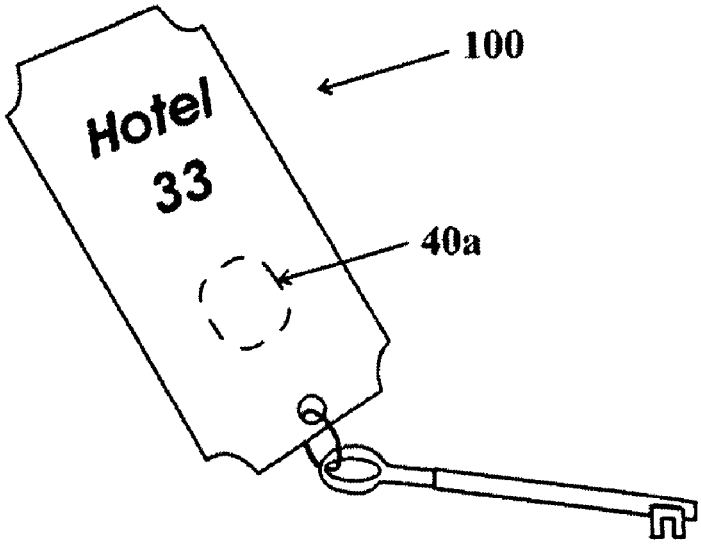
FIG. 4 is an illustration of a manufactured item incorporating an inclusive zone device, where the item can be functional, like a tool, or a fake that resembles something else, or decorative.

Referring to FIG. 4, which is an illustration of a manufactured item 100 incorporating an inclusive zone device 40*a*, where the item can be functional, like a tool, or a fake that resembles something else, or is decorative. The illustrated inclusive zone device 40*a* is a hotel key tag 100, manufactured to hide and incorporate the zone device 40*a*. Guests are frequently misplacing their key, and utilizing the inclusive zone device 40*a* would enable a search for the key to be faster. The key tag 100 could also be a luggage tag to aid in the collection of baggage at an airport carousel. Other examples have previously been discussed.

Figure 2:
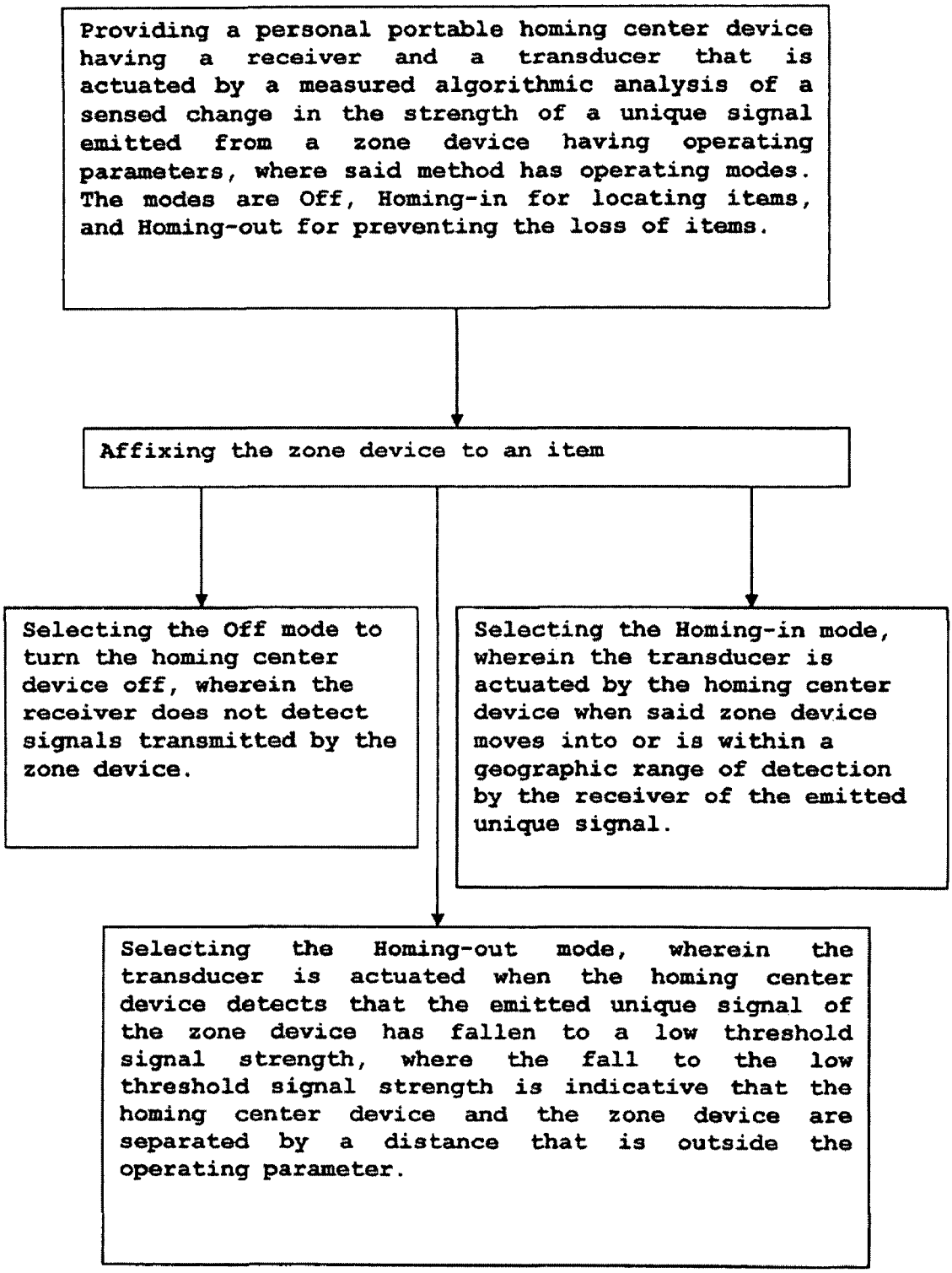

The method for locating and preventing the loss of personal items and the like is schematically shown in FIG. 2. There is provided a personal portable homing center device having a receiver and a transducer that is actuated by a measured algorithmic analysis of a sensed change in the strength of a unique signal emitted from a zone device having preset operating parameters. The method has operating modes. The modes are an Off mode, a Homing-in mode for locating items, and a Homing-out mode for preventing the loss of items. If the zone device is affixed to an item or as previously discussed is a component of the item, then depending on the desired operating mode, the user selects the mode. The Off mode turns the homing center device off, wherein the receiver does not detect signals transmitted by the zone device. In the Homing-in mode, the transducer is actuated by the homing center device when the zone device moves into or is within a geographic range of detection by the receiver of the emitted unique signal. Selecting the Homing-out mode causes the transducer to be actuated when the homing center device detects that the emitted unique signal of the zone device has fallen to a low threshold signal strength, and this is indicative that the homing center device and the zone device are separated by a distance that is outside the operating parameter. Notice, in the homing-out mode the separation can be a result of either the item being left behind as the homing center device is carried away, or the item is carried away, or a combination of both moving away from each other. Actuation ceases when the homing center device and the zone device are not separated by the distance outside the operational parameter. As previously discussed, if there are multiple zone devices then the method includes a means of identifying what item is causing the actuation. In the Homing-in mode, the method and system can also include setting an operating parameter for the transducer, such that the transducer will issue an audible signal that is pulsed inversely with respect the distance between the specific zone device and the homing center device, such that the shorter the distance, the faster the pulse.

While not explicitly illustrated the method also includes steps for adding additional zone devices. The additional zone device has a unique digital ID, and it is added to list of devices monitored by the homing center device. The additional zone device is assigned to a personal item, and classified as to operating mode, selected from Homing-in mode, Homing-out mode or both modes. If used in the Homing-out mode, then a threshold distance for actuation of the transducer is entered. If used in the Homing-in mode a pulse parameter can optionally be added. As previously discussed some zone devices, such as active RFIDs, can store and send more information than just their digital ID, and this information can be encoded in the zone device. The information would usefully include a description of the item and other information, which may be useful in tracking the item if the item is lost. The RFID could also provide the homing center device with the useful battery life was left.

Figure 3:
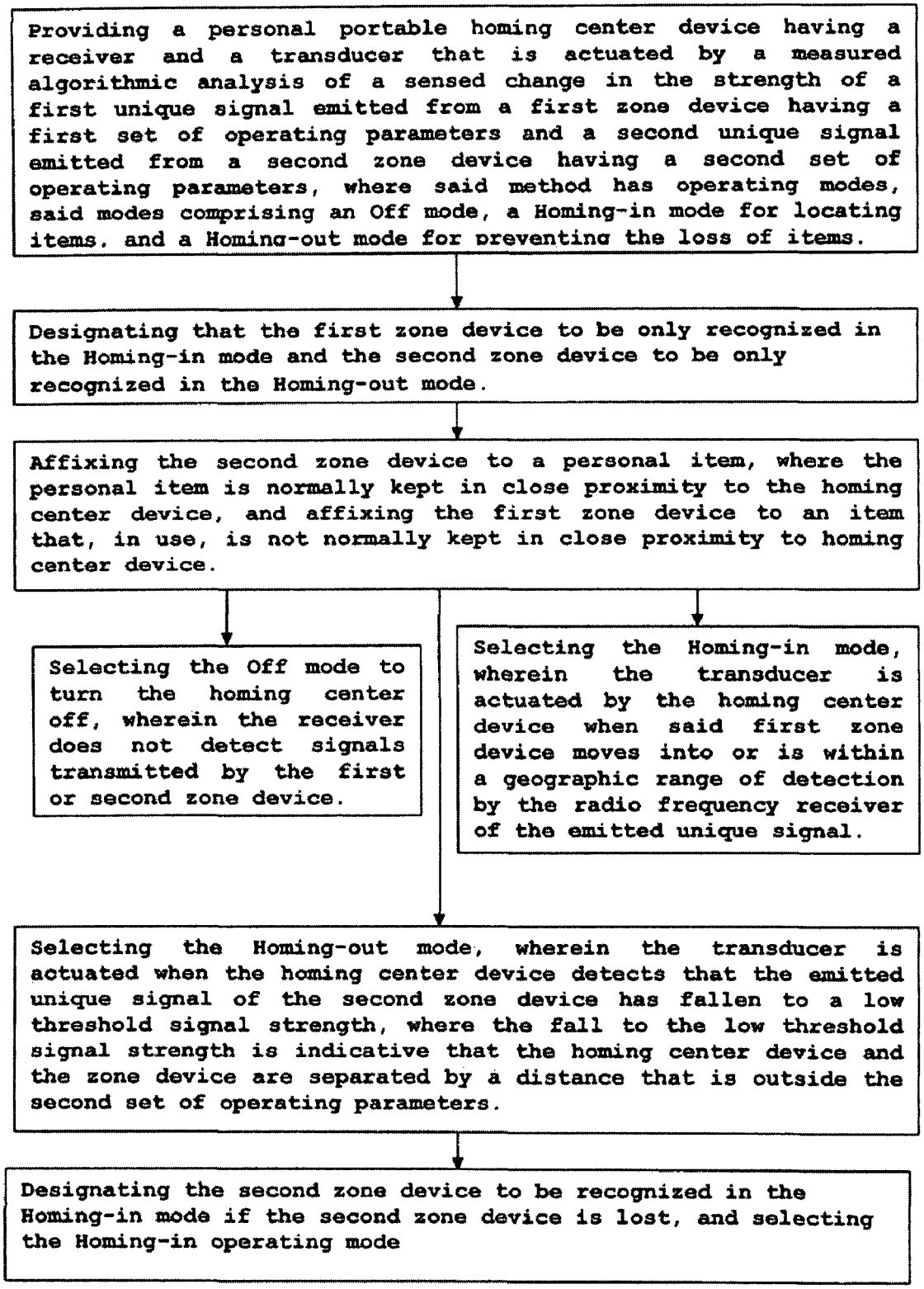

An alternate method for locating and preventing the loss of personal items and the like is shown in FIG. 3. In the alternate method there is provided a personal portable homing center device having a receiver and a transducer that is actuated by a measured algorithmic analysis of a sensed change in the strength of a first unique signal emitted from a first zone device having a first set of operating parameters and a second unique signal emitted from a second zone device having a second set of operating parameters. The method has three operating modes: an Off mode, a Homing-in mode for locating items, and a Homing-out mode for preventing the loss of items. The first zone device is designated to be only recognized in the Homing-in mode, and the second zone device is designated to be only recognized in the Homing-out mode. The second zone device is affixed or otherwise attached to an item that is normally kept in close proximity to the homing center device. Close is a relative term here, but generally inside 1000 ft; and the first zone device is affixed or otherwise attached to an item that, in use, is not normally kept in close proximity to homing center device. For instance, a piece of luggage is not normally always kept in close proximity. The mode is selected. The method further comprises the step of designating the second zone device to be recognized in the Homing-in mode if the second zone device is lost, and selecting the Homing-in operating mode. The strength of transmission of the second unique signal could optionally be changed remotely using a second transmitter. The user could then augment their search for the lost item by switching from the Homing-out mode to the Homing-in mode. The search may be facilitated by employing a directional antenna.

In a variation on the previously disclosed method, alternatively, a single item has both first and second zone devices.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function, it is intended that such claim be construed to cover the corresponding structure, material, or acts described in the specification and equivalents thereof, including both structural equivalents and equivalent structures.

What is claimed is:

1. A system for locating and preventing the loss of personal items and the like, said system comprising:

a personal portable homing center device that is a receiver comprising an algorithm to correlate distance as a function of a received signal strength, a switch for selecting an operating mode, and a transducer that is actuated by a sensed change in the received signal strength;

a zone device that is attached to a personal item and the like, where said zone device comprises a small portable transmitter that is transmitting a unique signal that is identifiable by the personal portable homing center device;

where, the sensed change is increasing if the homing center device and zone device are moving closer together or decreasing if they are moving further apart, and the sensed change is zero when the signal strength is not changing, either because the distance between the homing center device and zone device is constant or because the zone device is out-of-range of the receiver; and wherein the system has operating modes, said operating modes comprising an Off mode, a Homing-in mode for locating items, and a Homing-out mode for preventing the loss of items, where in the Off mode the homing center device is turned off, where in the Homing-in mode an output of the transducer indicates whether the homing center device and zone device are moving closer together or moving further apart, enabling the user to adjust his movements toward the zone device until the homing center device and zone device are together, whereupon the output from the transducer ceases as there is no sensed change and where in the Homing-out mode so long as the received signal strength detected by the homing center device remains above a threshold level, the output is suppressed even if there is a sensed change in the received signal strength, and when the received signal strength falls below the threshold level the output is generated even if there is no sensed change where the received signal strength is a function of distance between the zone device and the homing center device therein enabling the zone device a geographic range of movement, but still maintaining detection for retrieving personal items outside of the geographic range of movement, and where the mode of the homing center device can be switched from the Homing-out mode to the Homing-in mode to locate personal items that have moved outside of the geographic range, and can be switched from the Homing-in mode to the Homing-out mode to prevent the loss of personal items that have been retrieved.

2. The system according to claim 1, wherein said zone device is fastened to the item as a tag or a fob or other means suitable for fastening.

3. The system according to claim 2, wherein said tag is an active RFID tag.

4. The system according to claim 1, wherein said unique signal transmitted by the zone device uniquely identifies any given zone device.

5. The system according claim 4, wherein said unique signal conveys a digital ID for the zone device.

6. The system according to claim 5, wherein the zone device attached to the personal item is classified as to its operating mode.

7. The system according to claim 6, wherein the operating mode has operating parameters, which are specific to any given zone device.

8. The system according to claim 7, wherein the operating Homing-in parameter for the output of the transducer is that it will issue an audible signal that is pulsed inversely with respect to the distance between the specific zone device and the homing center device, such that the shorter the distance, the faster the pulse.

9. The system according to claim 7, wherein the operating Homing-out parameter for the threshold level between the specific zone device and the homing center device is used to monitor that tools and the like are not taken off a work site, and the threshold level is selected from a parameter value of 1000 feet or less.

10. The system according to claim 5, wherein the unique signal transmitted by the zone device contains a description of the item it is attached to, and other information about item.

11. The system according to claim 6, wherein the digital ID of the zone device attached to the personal item is cross-referenced to a unique identifier retained by the homing center device, and the homing center device associates the zone device and operating mode with a specific personal item.

12. The system according to claim 3, wherein the personal item is manufactured with an inclusive zone device, where the inclusive zone device is masked by the personal item.

13. The system according to claim 1, wherein the output generated by the transducer is selected from the group consisting of an audible output, a silent output, and a combination thereof.

14. A method for locating and preventing the loss of personal items and the like, said method comprising:

providing a personal portable homing center device having a receiver and a transducer that is actuated by a sensed change in a signal strength from a zone device regularly transmitting a unique signal that is identifiable by the personal portable homing center device, where said method has operating modes, said modes comprising an Off mode, a Homing-in mode for locating items, and a Homing out mode for preventing the loss of items;

affixing the zone device to an item;

selecting the Off mode to turn the personal portable homing center device off, wherein the receiver does not detect signals transmitted by the zone device; or selecting the Homing-in mode, wherein the transducer is actuated by the personal portable homing center device when, sequentially, said zone device or the personal portable homing center move into a geographic range where a sensed change in the strength of the transmitted signal of the zone device can be detected by the receiver, where the sensed change in strength is affected by a user carrying the portable homing center device either closer to or further away from the zone device or by movement of the zone device towards or away from the portable homing center device, wherein the transducer is actuated producing an output that indicates whether the homing center device and zone device are moving closer together or further apart, therein enabling the user to adjust his movements toward the zone device until the homing center device and zone device are together, whereupon output by the transducer ceases as there is no sensed change; or selecting the Homing-out mode, wherein there is no output so long as the received signal strength detected by the homing center device remains above a threshold level even if there is a sensed change in the received signal strength, and when the personal portable homing center device detects that the transmitted unique signal of the zone device has fallen to a low threshold signal strength an output is generated even if there is no sensed change in the received signal strength, where the fall to the low threshold signal strength is indicative that the homing center device and the zone device are separated by a distance which is outside an operating parameter, therein enabling the affixed zone device to have a range of movement, but still maintaining contact to recover personal items that are outside the operating parameter.

15. The method according to claim 14 further comprising the steps of:

adding an additional zone device;

reading the additional zone device unique digital ID into the homing center device;

assigning the additional zone device to a personal item and the like;

classifying the additional zone device as to operating mode, selected from Homing-in mode, Homing-out mode and both modes;

entering a Homing-out mode threshold distance operating parameter;

entering a Homing-in mode pulse parameter for the transducer with respect to the distance between the specific zone device and the homing center device, such that the shorter the distance, the faster the pulse; and writing to the additional zone device a description of the item and other information which may be useful in tracking the item if the item is lost.

16. A method for locating and preventing the loss of personal items and the like, said method comprising:

providing a personal portable homing center device having a receiver and a transducer that is actuated by a sensed change in a signal strength of a first unique signal transmitted from a first zone device having a first set of operating parameters and a second unique signal transmitted from a second zone device having a second set of operating parameters which includes a low threshold signal strength, where said method has operating modes, said modes comprising an Off mode, a Homing-in mode for locating items, and a Homing-out mode for preventing the loss of items;

designating that the first zone device to be only recognized in the Homing-in mode;

designating that the second zone device to be only recognized in the Homing-out mode;

affixing the second zone device to a personal item, where the personal item is normally kept in close proximity to the homing center device;

affixing the first zone device to an item that, in use, is not normally kept in close proximity to the homing center device;

selecting the Off mode to turn the homing center off, wherein the receiver does not detect signals transmitted by the first or second zone device; or selecting the Homing-in mode, wherein the transducer is actuated by the homing center device when said first zone device or the personal portable homing center move into or are within a geographic range where a sensed change in the strength of the transmitted signal of the first zone device can be detected by the receiver, where the sensed change in strength is affected by a user carrying the portable homing center device either closer to or further away from the first zone device or by movement of the first zone device towards or away from the portable homing center device, wherein the transducer is actuated producing an output that indicates whether the homing center device and first zone device are moving closer together or further apart, therein enabling the user to adjust his movements toward the first zone device until the homing center device and first zone device are together, whereupon output by the transducer ceases as there is no sensed change; or selecting the Homing-out mode, wherein there is no output so long as the received signal strength detected by the homing center device from the second zone device remains above the low threshold signal strength, even if there is a sensed change in the received signal strength, and when the homing center device detects that the transmitted unique signal of the second zone device has fallen to the low threshold signal strength, an output is generated even if there is no sensed change in the received signal strength where the fall to the low threshold signal strength is indicative that the homing center device and the zone device are separated by a distance greater than the second set of operating parameters, therein enabling the affixed second zone device to have a range of movement, but still maintaining contact to recover personal items that are outside the operating parameter.

17. The method according to claim l6 further comprising the step of:

designating the second zone device to be temporary recognized in the Homing-in mode if the second zone device is lost; and selecting the Homing-in operating mode.

18. The method according to claim 16, wherein a single item has both first and second zone devices.

* * * * *